US009933233B1

(12) United States Patent
Roccisano

(10) Patent No.: US 9,933,233 B1
(45) **Date of Patent: *Apr. 3, 2018**

(54) BALLISTIC VEST AND HOLSTER COMBINATION

(71) Applicant: Pietro G Roccisano, Coral Springs, FL (US)

(72) Inventor: Pietro G Roccisano, Coral Springs, FL (US)

( * ) Notice: Subject to any disclaimer, the term of this patent is extended or adjusted under 35 U.S.C. 154(b) by 36 days.

This patent is subject to a terminal disclaimer.

(21) Appl. No.: 15/061,185

(22) Filed: Mar. 4, 2016

Related U.S. Application Data

(63) Continuation-in-part of application No. 12/023,553, filed on Jan. 31, 2008, now Pat. No. 9,297,611.

(51) Int. Cl.
*F41C 33/00* (2006.01)
*F41C 33/02* (2006.01)
*F41H 1/02* (2006.01)

(52) U.S. Cl.
CPC ..... *F41C 33/0209* (2013.01); *F41H 1/02* (2013.01)

(58) Field of Classification Search
CPC ..... A45F 5/02; A45F 3/14; Y10S 224/911; F41H 1/02; A41D 13/0012; A41D 2400/70; F41C 33/0209; F41C 33/0218; F41C 33/048
USPC ..... 224/646, 647, 259, 677
See application file for complete search history.

(56) References Cited

U.S. PATENT DOCUMENTS 9,297,611 B1 * 3/2016 Roccisano ..... F41C 33/0209

* cited by examiner

*Primary Examiner* — Adam Waggenspack
(74) *Attorney, Agent, or Firm* — H. John Rizvi; Gold & Rizvi, P.A.

(57) ABSTRACT

A combination of a ballistic vest and a removable firearm holster is disclosed, for providing a ballistic vest with an optional, external, readily accessible yet secure chest firearm holster. The holster has a firearm receiving section formed between a holster rear panel and a holster front panel. The panels are connected along a bottom and optionally along a lower portion of each of the sides. A top region of the front panel can be pulled away from the rear panel to gain access to a firearm stored in the holster. The panels are coupled via a quick-release fastening material disposed along the upper portion of each side, facilitating pulling off the front panel. One or more shoulder strap engaging portions extend from the holster rear panel to secure the holster rear panel to one or more shoulder straps of the ballistic vest.

20 Claims, 14 Drawing Sheets

BALLISTIC VEST AND HOLSTER COMBINATION

CROSS-REFERENCE TO RELATED APPLICATION

This application claims the benefit of co-pending U.S. Utility patent application Ser. No. 12/023,553, filed Jan. 31, 2008, which is incorporated herein in its entirety.

FIELD OF THE INVENTION

The present invention relates generally to a pocket for holstering a backup gun. More specifically, the present invention relates to a combination of a ballistic vest and a removable firearm holster, wherein a rear panel of the holster attaches to a front torso protection panel and to shoulder straps of the ballistic vest, and a front panel of the holster can be pulled frontward to access a firearm housed in the holster.

BACKGROUND OF THE INVENTION

Law enforcement personnel are trained and outfitted to anticipate dangerous situations. A key instrument the law enforcement person relies upon is a firearm. Such so, that the law enforcement person maintains at least one and sometimes a second backup firearm. There are many reasons why a law enforcement person would maintain a backup firearm. The secondary firearm is commonly concealed and secured to the person via an ankle holster or a shoulder holster. Carrying a firearm in any of these locations can create certain difficulties in quickly accessing the firearm.

Normally, the person stores the firearm on the side of their body opposing the primary hand. There are many circumstances making access to the backup firearm held via the above means difficult or even potentially impossible. One such issue occurs when the person is injured. Another can simply result for the position the person is placed. Yet another can be circumstantial, such as during a physical encounter with a suspect. A firearm in an ankle holster can be difficult to reach, as it is located at the farthest point from one's hands. A shoulder holster is designed to have a firearm grabbed by the hand opposite the arm in which the firearm is secured. It can be difficult to reach if the person is injured on the non-firearm side.

Another method of protection is the use of a ballistic vest. A ballistic vest is an armored garment, often referred to as a "bullet proof vest." The vests typically comprise layers formed of a ballistic resistant fabric, such as Kelvar®. A vest does not protect the wearer by deflecting bullets. Instead, the layers of material catch the bullet and spread its force over a larger portion of the body, absorbing energy more quickly and hopefully bringing it to a stop before it penetrates the body. This tends to deform the bullet, further reducing its ability to penetrate. While a vest can prevent bullet wounds, the wearer still absorbs the bullet's energy, which can cause blunt force trauma. The majority of users experience only bruising, but impacts can still cause severe internal injuries. The material is extremely lightweight, thin, and flexible, making the vest comfortable to wear. The vest further includes a plurality of straps or belts for adjustably securing the vest to the wearer. The straps secure about the wearer's shoulders and waist.

One form factor is directed towards a civilian application and worn between an undershirt and an outer shirt such as the wearer's uniform. The civilian form factor generally incorporates a waist strap, which is secured via Velcro.

Another form factor is directed towards a military application and worn externally. Military applications incorporate a plurality of fastening webbing and loops (MOLLE) providing a versatile and configurable tool holder design.

MOLLE, pronounced like Molly, the feminine name, is an acronym for Modular Lightweight Load-carrying Equipment. It is used to define the current generation of load-bearing equipment and rucksacks utilized by the United States Army. The system's modularity is derived from the use of PALS webbing, rows of heavy-duty nylon stitched onto the vest as to allow for attachment of various MOLLE compatible pouches and accessories.

The Pouch Attachment Ladder System or PALS is a grid of webbing invented and patented by United States Army Natick Soldier Research, Development and Engineering Center used to attach smaller equipment onto load bearing platforms, such as vests and backpacks. PALS consists of webbing sewn onto the load-bearing equipment and corresponding webbing and straps on the attachment. The straps are interwoven between the webbing on each of two pieces and finally snapped into place, making for a very secure fit, which can be detached with moderate effort. The PALS grid consists of horizontal rows of 1" Mil-W-43668 Type II nylon webbing (most commercial vendors use Type IIIa), spaced 1" apart, and reattached to the backing at 1.5" intervals.

Accordingly, it would be desirable to provide an apparatus in which a user can conceal a backup firearm that is readily and easily accessible for use during any dangerous situation.

SUMMARY OF THE INVENTION

The present invention refers to a combination of a ballistic vest and a removable firearm holster, wherein a rear panel of the holster attaches to a front torso protection panel and to shoulder straps of the ballistic vest, while waist straps of the ballistic vest attach to a bottom region of a front side of a front panel of the holster. A top region of the front panel of the holster can be pulled frontward to access a firearm housed in the holster. The invention thus allows providing an existing ballistic vest of the kind including bottom waist straps with an optional, removable accessory holster capable of carrying a backup firearm. The holster can be placed approximately on the user's chest, and thus readily accessible, and protectable, by any one of the user's hands. The user can instinctively and quickly pull the holster open to access the backup gun, without affecting the tight and firm securing of the holster to the ballistic vest. The attachment of the holster to the shoulder straps of the ballistic vest is particularly useful in keeping the rear panel of the holster in place when the user pulls on the top region of the front panel.

In a first implementation of the invention, a ballistic vest and holster combination includes a ballistic vest and a holster that is removably attachable to the ballistic vest. The ballistic vest includes a rear torso protection panel, a front torso protection panel, a pair of shoulder straps extending between the panels, and at least one waist strap extending from each side of the rear torso protection panel. Each waist strap includes a section of waist strap engaging material capable of engaging with a section of mating waist strap engaging material spanning across a lower region of the front torso protection panel. The holster, in turn, includes a front panel and a rear panel, the front panel and rear panel connected to one another along a lower edge thereof. A quick-release fastening feature is disposed upon facing left and right sides of each of the front and rear panels. A firearm pocket is formed between the coupled front and rear panels upon fastening the quick-release fastening feature. The front panel can be pulled away from the rear panel to facilitate access to the firearm pocket. The holster further includes a holster-to-vest securing feature disposed upon a lower portion of an exterior side of the rear panel. The holster-to-vest securing feature is compatible for coupling with the mating waist strap engaging material of the front torso protection panel of the ballistic vest. In addition, the holster includes a front coupling feature affixed to a lower portion of an exterior side of the front panel. The front coupling feature is compatible for coupling with the waist strap engaging material of the at least one waist strap of the ballistic vest. At least one shoulder strap engaging portion is affixed to and extends from the rear panel and is configured to disconnectably engage with one of the shoulder straps of the ballistic vest and secure the rear panel of the holster in place when pulling the front panel away from the rear panel.

These and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs., in which.

Figure 1:
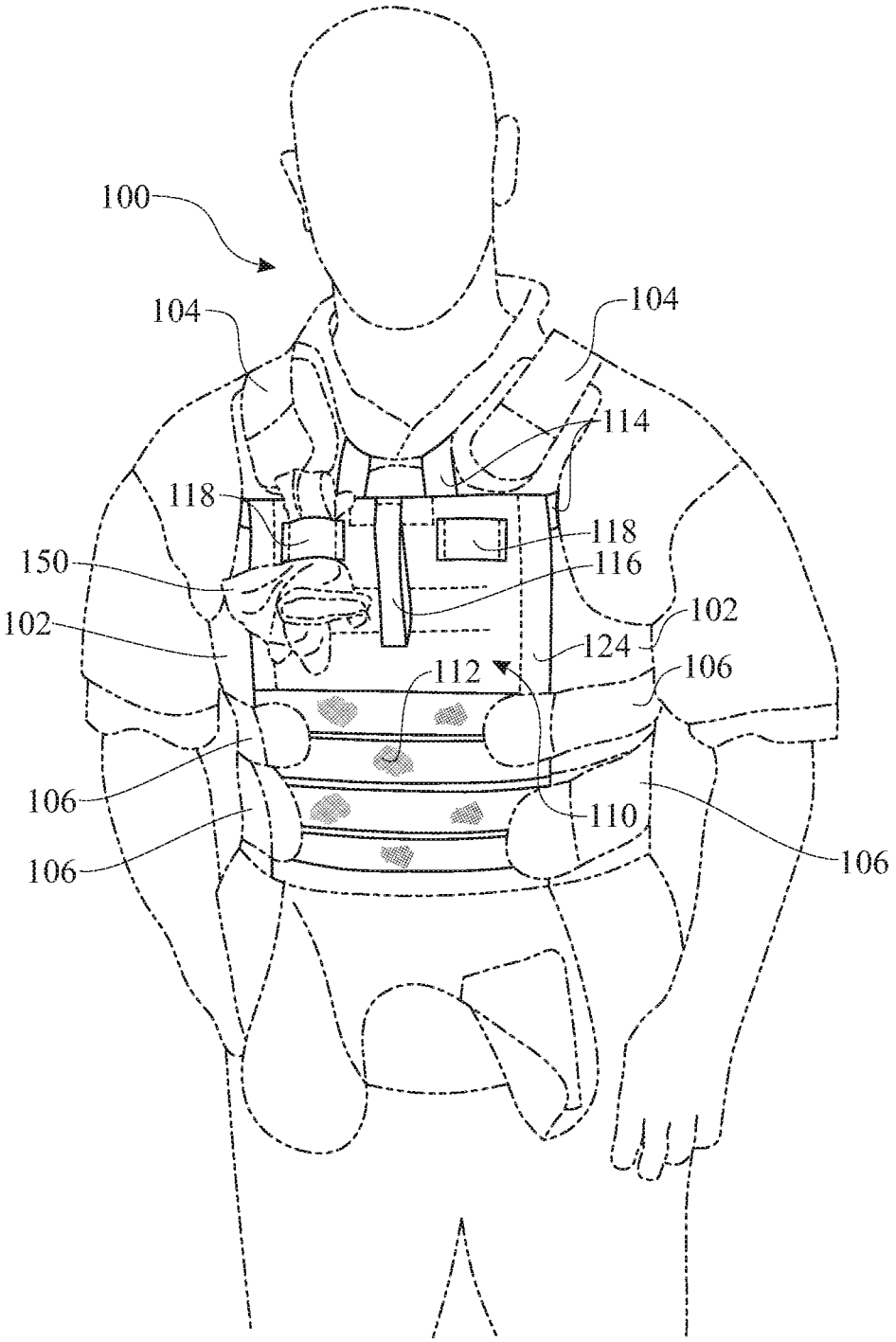
FIG. 1 is a front view of a ballistic vest and holster combination in accordance with a first exemplary embodiment of the invention, the holster shown secured to the ballistic vest, the holster also being shown in a closed state.

Repeated use of reference characters in the present specification and drawings is intended to represent the same or analogous features or elements of the invention.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
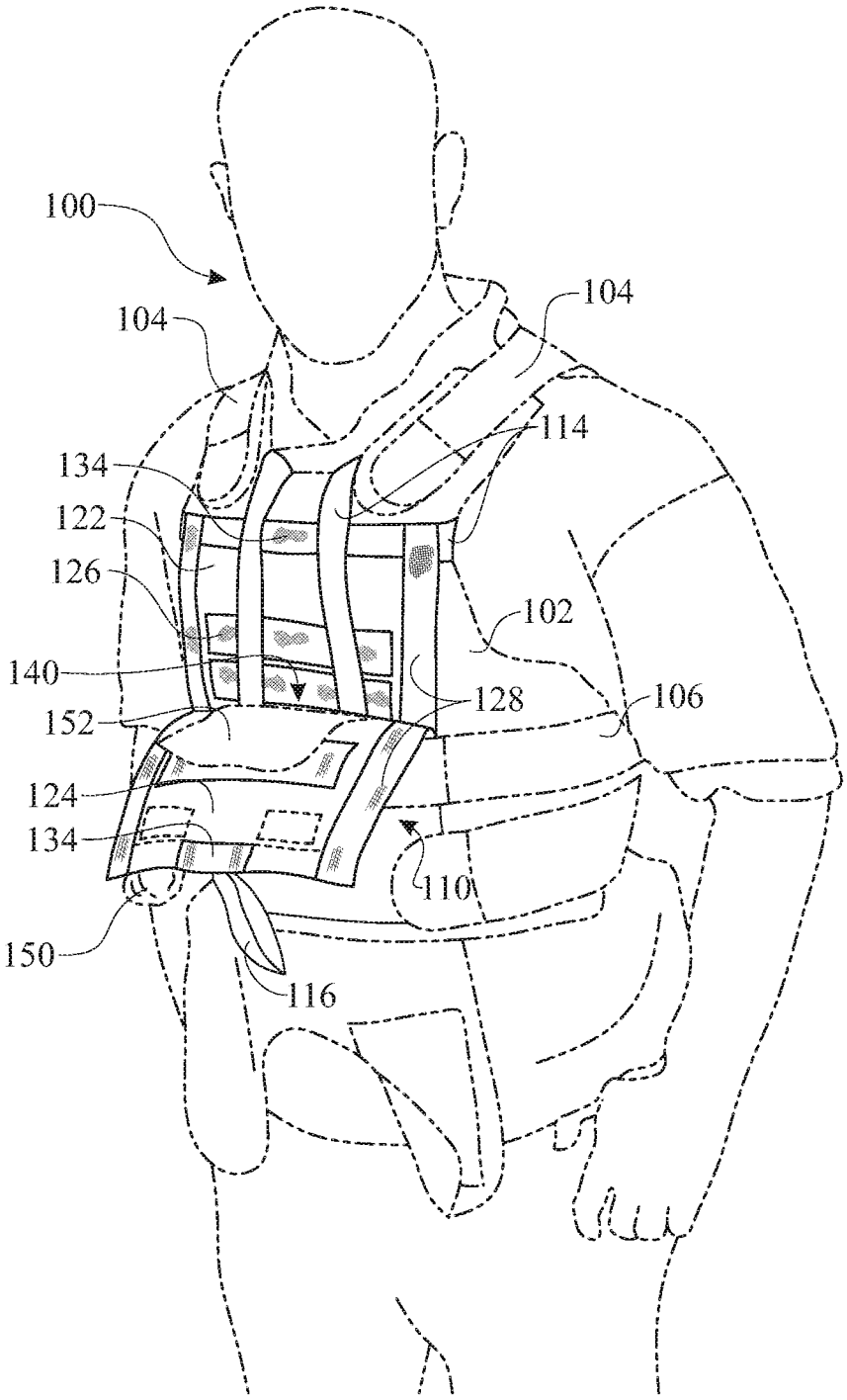
FIG. 2 is a front view of the ballistic vest and holster combination of FIG. 1, the holster shown in an open state.
Figure 3:
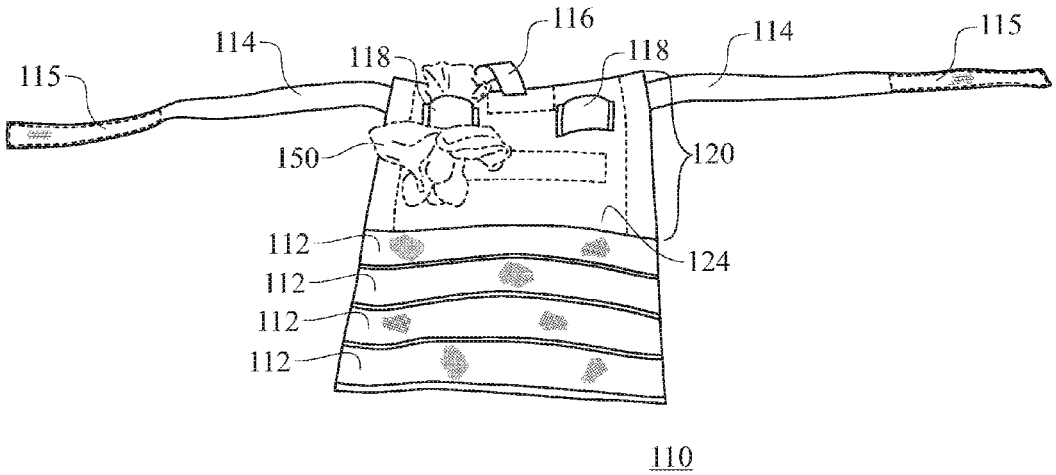
FIG. 3 is a front view of the holster of FIG. 1, the holster shown in a closed state.
Figure 4:
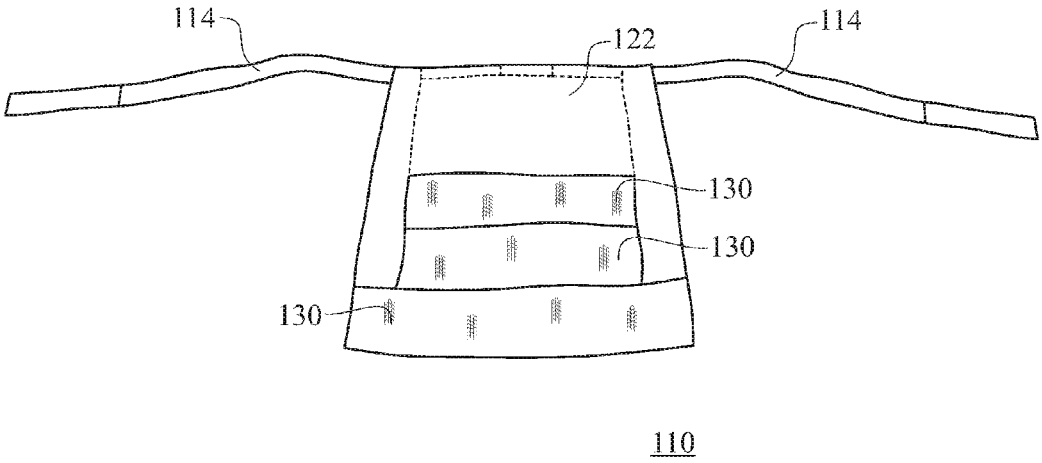
FIG. 4 is a rear view of the holster of FIG. 1, the holster shown in a closed state.
Figure 8:
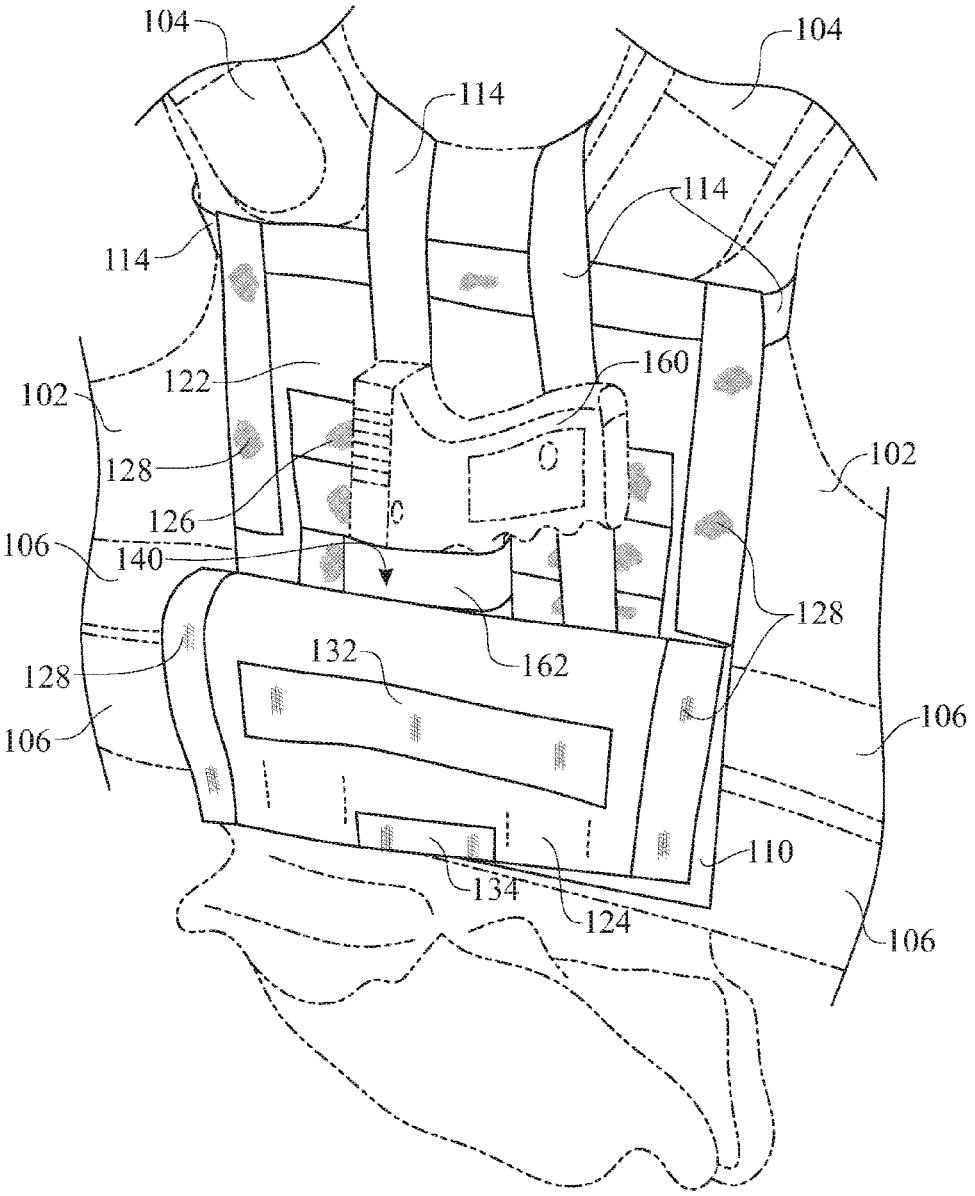
FIG. 8 is a front view of the ballistic vest and holster combination of FIG. 1, the holster being shown in an open state, further introducing a firearm and respective firearm holder.

The present invention provides a firearm holster 110, an exemplary embodiment of which is presented in FIGS. 1 through 12. With reference initially to FIGS. 1 and 2, a wearer 100 is illustrated wearing a bulletproof or ballistic vest 102, the ballistic vest 102 having a holster 110 secured thereon. The ballistic vest 102 is secured to the wearer 100 via waist straps 106 positioned about a waist of the wearer 100 and a pair of shoulder straps 104 about each shoulder of the wearer 100. The holster 100 is generally comprised of a front panel 124 and a rear panel 122. The rear and front panels 122, 124 form a firearm receiving section 140 therebetween for storing a firearm 160 (FIG. 8).

The holster 110 is fastened to a front, upper portion of the ballistic vest 102 by wrapping upper securing straps 114 of the holster 110 about each of the shoulder straps 104 and securing the distal end of the securing straps 114 to an internal fastening material 126 of the holster 110. The internal fastening material 126 is fabricated of a compatible fastening material respective to the material affixed to the securing straps 114, such as a dense hook-and-loop fastening system (e.g., Velcro®). The holster 110 is fastened to a front, lower region of the ballistic vest 102 by a fastening feature;

one half of the fastening feature (a holster-to-vest securing feature 130) is disposed upon the backside of the holster 110 and the opposing half of the fastening feature (not shown) is disposed upon the front of the ballistic vest 102. The holster 110 further includes a front coupling feature 112 on a lower portion of an exterior side of the holster 110 as shown in FIG. 1. The waist straps 106 are secured to the front coupling feature 112. The front coupling feature 112 can utilize any known coupling feature for securing accessories or tools to the front of the holster 110. For instance, the illustrated front coupling feature 112 can comprise a dense hook-and-loop material and can be provided via either a single or a plurality of strips (as shown). A holster access finger loop 116 can be assembled to the top center of the front panel 124. At least one accessory securing loop 118 can be attached to the front of the holster 110, i.e. to an exterior side of the front panel 124 of the holster 110; the accessory securing loops 118 provide a means for securing items such as safety gloves 150.

Additional details of the holster 110 are presented in FIGS. 3 through 7. The rear panel 122 and the front panel 124 of the holster 110 are preferably of a rectangular shape, and are interconnected along a lower edge and optionally secured vertically along a lower portion of each of a left and a right side of the panels 122, 124. The side configuration provides a pocket opening section 120 (FIG. 3) along the upper portion of the holster 110. A quick-release fastener 128 is incorporated along each of a left side and a right side of the rear and front panels 122, 124 of the holster 110. An optional quick-release fastener 134 is incorporated proximate a center of a top portion of each of the rear panel 122 and front panel 124. The quick-release fasteners 128, 134 provide a reliable fastening interface capable of being opened quickly and easily in the event that the wearer 100 pulls the front panel 124 of the holster 110 frontward and away from the rear panel 122 to access the firearm receiving section 140. The quick-release fasteners 128, 134 are preferably of a dense hook-and-loop fastener (e.g., Velcro®). However, it is recognized that other fastening interface designs, which provide a quick-release coupling feature, can be utilized additionally or alternatively to a hook-and-loop fastener. As mentioned heretofore, a holster access finger loop 116 can be attached to the upper, center of the front panel 124, providing the wearer with a device for assisting in pulling the front panel 124 and quickly accessing the firearm 160 stored within the firearm receiving section 140 of the holster 110.

As mentioned heretofore, a holster-to-vest securing feature 130 is affixed to the exterior of the lower rear portion of the holster 110, and used for securing the lower portion of the holster 110 to the opposing connecting portion disposed upon the ballistic vest 102. The front coupling feature 112 is affixed to the exterior of the lower front portion of the holster 110 as a means for transposing the features of the connecting portion disposed upon the ballistic vest 102 to the front of the holster 110. The upper portion of the holster 110 is secured by looping the securing straps 114 between the shoulder straps 104 and the shoulder of the wearer 100. The securing straps 114 are then secured by coupling a strap fastener 115 (affixed to each distal end of the securing straps 114) to the internal fastening material 126 within the firearm receiving section 140.

The rear and front panels 122, 124 can be fabricated of any material, based upon the specific application. The panels can be fabricated of canvas, heavy cotton, leather, polyester, Kevlar, and the like, for instance and without limitation. Additionally, the panels can be fabricated of a composite of a blend of the above or other materials. The edges of the panels are finished to avoid any fraying. The edge finishing process can be of any known means, such as but not limited to fold and stitching, edging, surging, and the like. The holster access finger loop 116, accessory securing loops 118, and other similar components can be fabricated from canvas webbing, for instance and without limitation.

Figure 5:
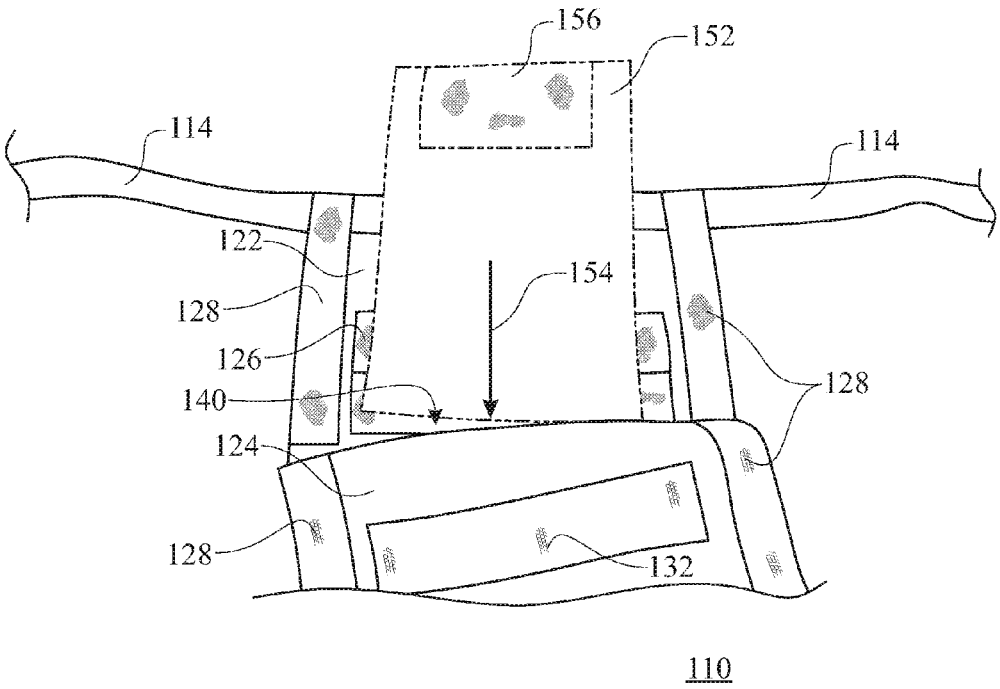
FIG. 5 is a front view of the holster of FIG. 1, the holster being shown in an open state, further introducing a trauma plate.
Figure 6:
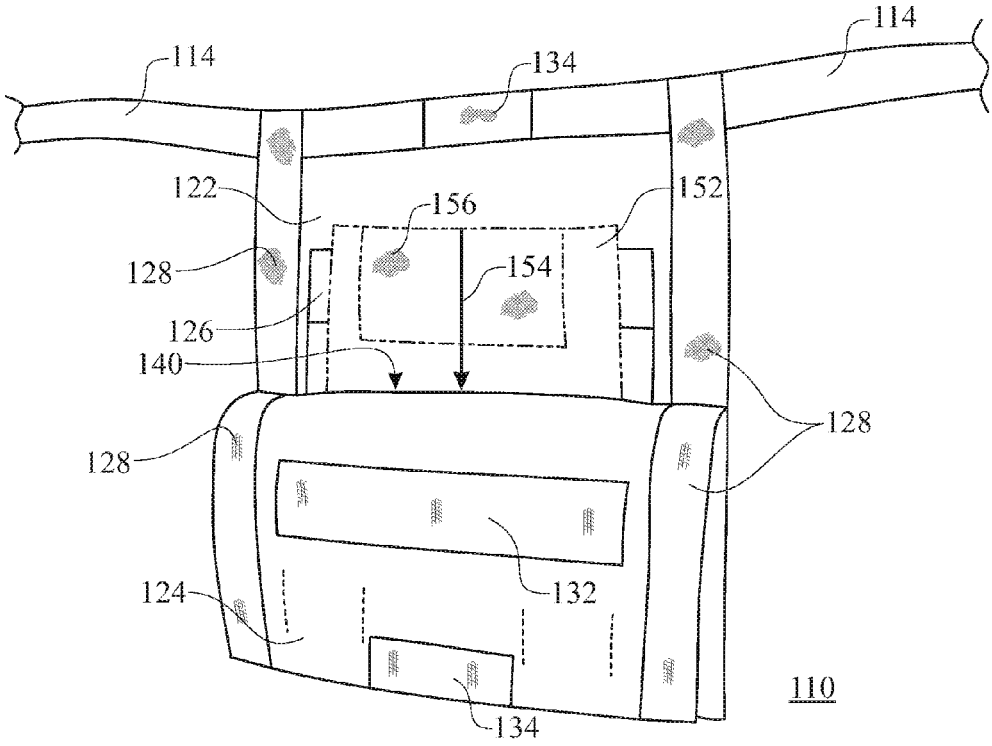
FIG. 6 is a front view of the holster as shown in FIG. 5, the trauma plate being inserted into the holster.
Figure 7:
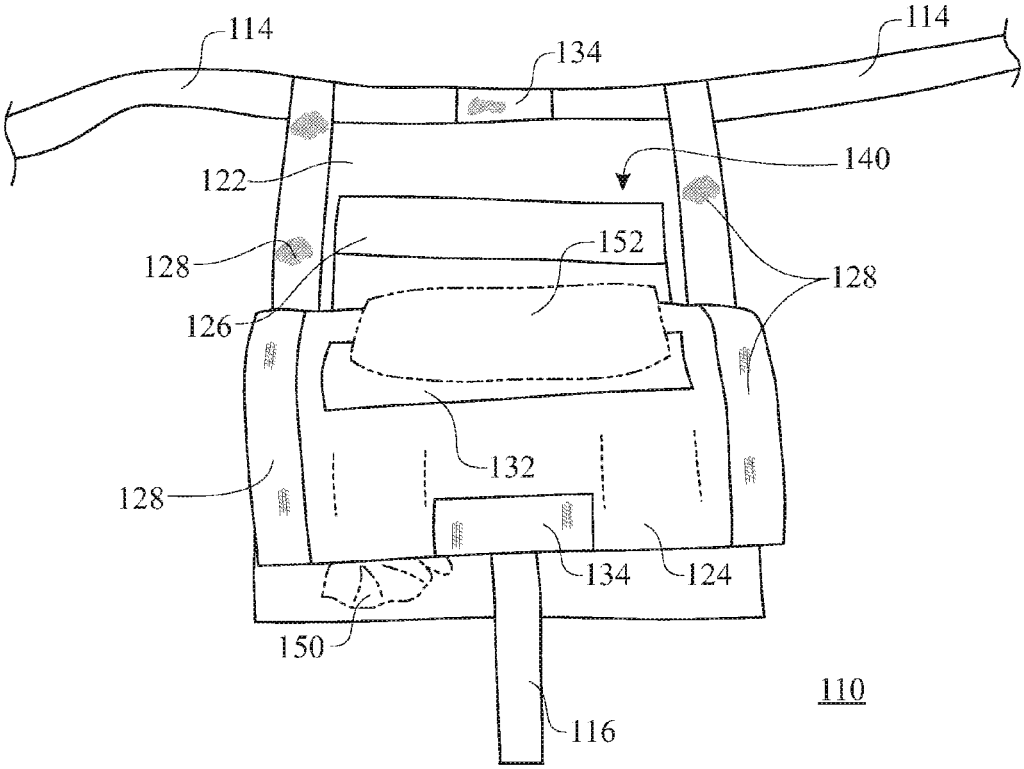
FIG. 7 is a front view of the holster as shown in FIG. 5, the trauma plate shown as inserted and secured into the pocket.

In some embodiments, a removably insertable trauma pad 152 can be inserted into the holster 110, as indicated by arrow 154 in FIGS. 5 and 6, providing additional safety to the wearer 100. The trauma pad 152 can include a plate fastening strip 156, which can be utilized to removably fasten the trauma pad 152 within the pocket. The plate fastening strip 156 depicted herein is affixed to a front internal fastening strip 132 arranged on an interior surface of the rear panel 122 facing the firearm receiving section 140. The trauma pad 152 can be fabricated of any soft, pliable material, and optionally include additional ballistic protection. Examples include rubber, foam, quilted materials, as well as Kevlar®, and the like.

Figure 9:
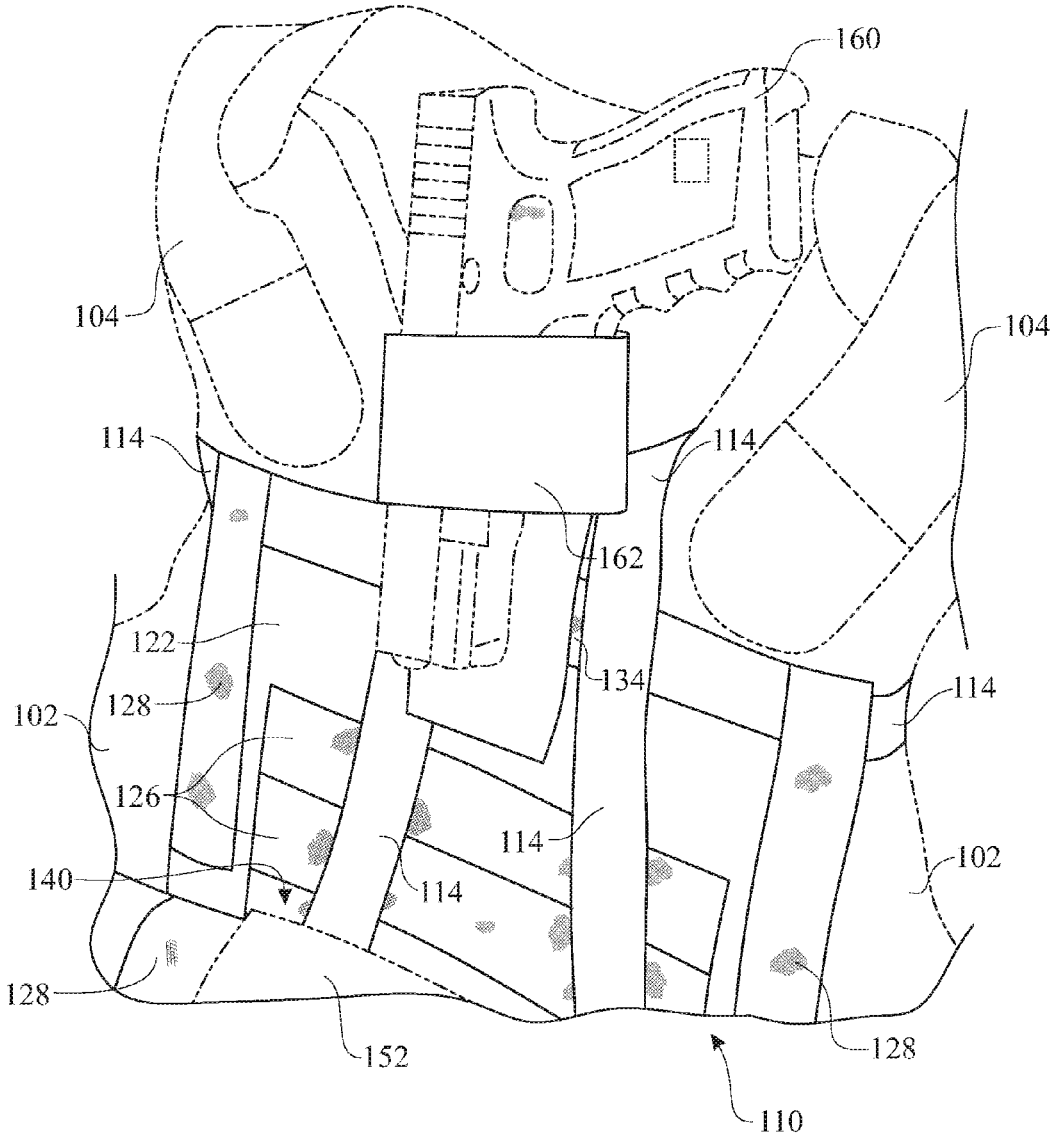
FIG. 9 is an enlarged, front view of the ballistic vest and holster combination of FIG. 8, the firearm and respective firearm holder shown being removed from the holster.

The firearm 160 can be stored within the firearm receiving section 140 of the holster 110 as presented in FIGS. 8 and 9. The firearm 160 can be placed within a firearm holder 162 and inserted into the firearm receiving section 140. Details of the firearm holder 162 will be presented by FIGS. 10 through 12, which will be discussed later herein. The firearm holder 162 is secured to the internal fastening material 126 via a quick-release, fastening interface such as a hook-and-loop fastener (e.g., Velcro®), one or more snap fasteners, or the like. By securing the trauma pad 152 to the front internal fastening strip 132 of the rear panel 122, when the wearer 100 pulls open the front panel 124 of the holster 110, the trauma pad 152, which is affixed to the front panel 124, is folded outward providing completely unobstructed access to the firearm 160, which is affixed to the rear panel 122 by means of the firearm holder 162. The configuration provides the wearer 100 with optimal access to the firearm 160 using both their left and right hands. By securing the securing straps 114 to the shoulder straps 104 of the ballistic vest 102, the top portion of the rear panel 122 remains in place when the user pulls the top portion of the front panel 124 forward to open the holster 110, thus allowing the top portion of the front panel 124 to disengage from the top portion of the rear panel 122. In addition, by securing the securing straps 114 to the internal fastening material 126 arranged inside the holster 110, the configuration minimizes any potential interference of the securing straps 114 respective to the hasty removal of the firearm 160. Further, by securing the securing straps 114 to the internal fastening material 126 arranged inside the holster 110, unauthorized access to the securing straps 114 by a third person in order to pull the holster 110 off the ballistic vest 102 is prevented.

Figure 10:
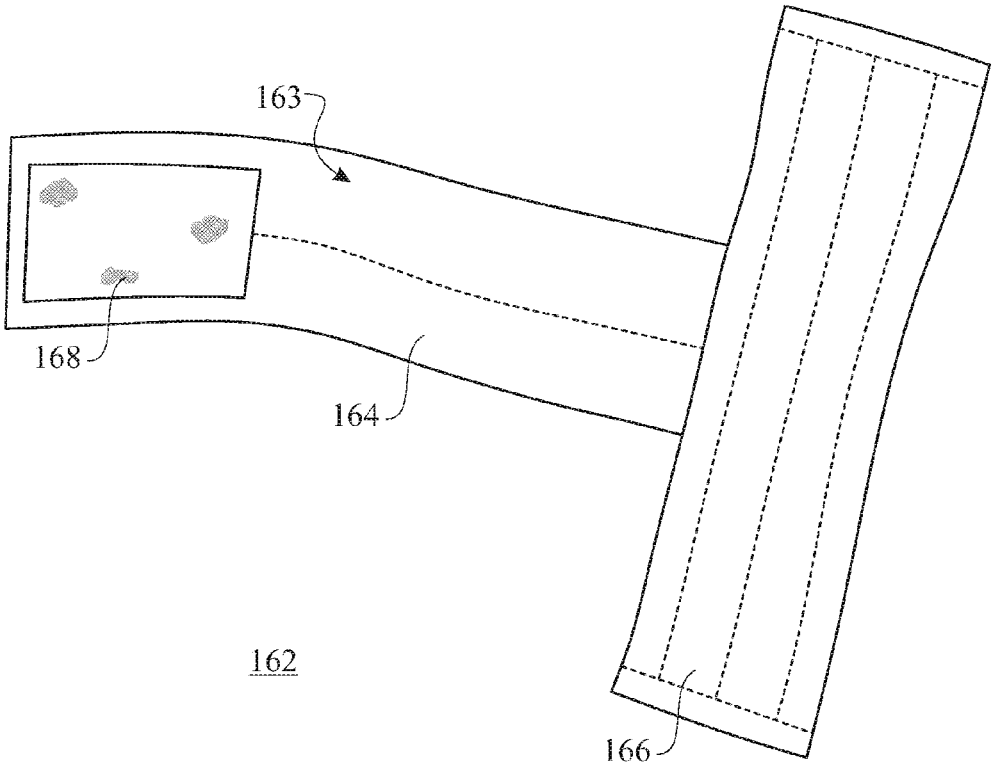
FIG. 10 is a front view of the firearm holder of FIG. 8, shown in an open configuration.
Figure 11:
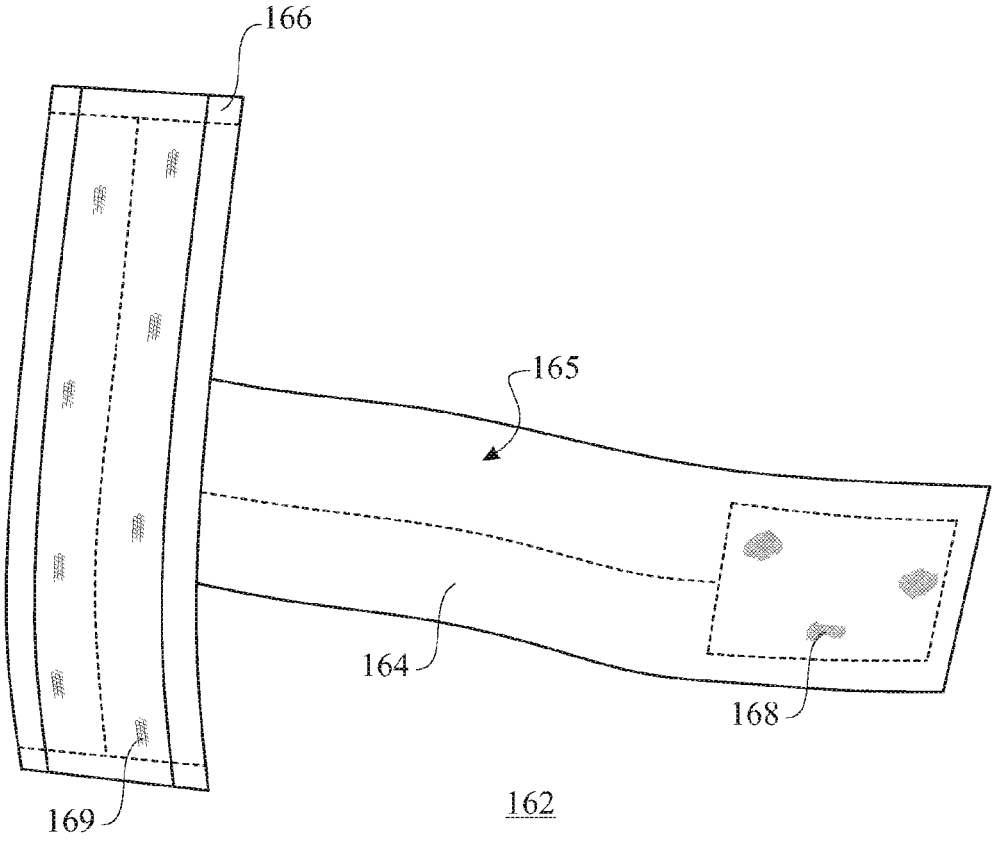
FIG. 11 is a rear view of the firearm holder of FIG. 8, shown in an open configuration.
Figure 12:
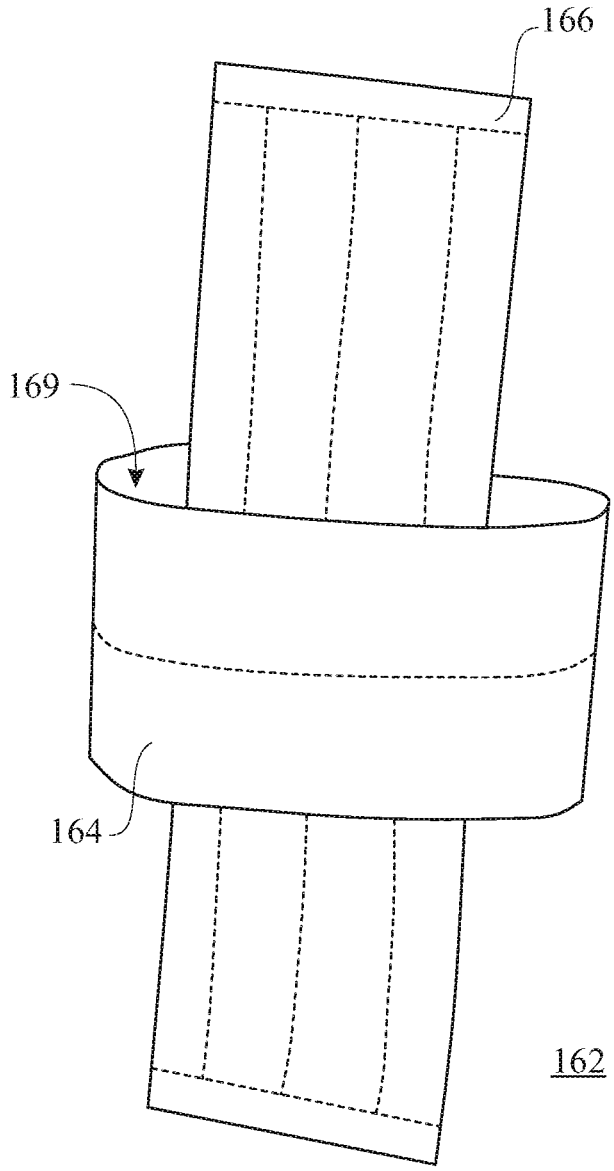
FIG. 12 is a front view of the firearm holder of FIG. 8, shown in a looped configuration.

As mentioned heretofore, an exemplary embodiment of the firearm holder 162 is presented in FIGS. 10 through 12. The illustrations of FIGS. 10 and 11 show the firearm holder 162 in a substantially flat, open state, where a firearm contacting side 163 of the firearm holder 162 is presented in FIG. 10 and an exposed side 165 of the firearm holder 162 is presented in FIG. 11. In turn, the illustration of FIG. 12 shows the firearm holder 162 in an assembled or looped configuration. The design of the firearm holder 162 ensures against any interference with the operation of the firearm 160. The firearm holder 162 is fabricated having a holster wrap panel 164 and a mounting panel 166, the mounting panel 166 being assembled perpendicularly to an end of the holster wrap panel 164 in a T-shaped arrangement. A wrap fastening material 168 is affixed to both the firearm contacting side 163 and the exposed side 165 of the firearm holder 162 proximate the end of the holster wrap panel 164 opposing the mounting panel 166. A mounting panel fastening material 169 is affixed to the exposed side 165 of the mounting panel 166, preferably covering the majority of the exposed side 165 of the mounting panel 166, providing a means for securing the wrap fastening material 168 to the mounting panel fastening material 169 as well as the internal fastening material 126. As shown in FIG. 12, the holster wrap panel 164 can be formed into a loop. The loop is preferably adjustable so that, as shown in FIGS. 8 and 9, the loop can have a snug fit about the firearm 160. The ends of the mounting panel 166 remain available for utilizing the exposed portion of the wrap fastening material 168 for securing the firearm holder 162 within the firearm receiving section 140. A canvas webbing material can be used for fabricating the firearm holder 162. A dense hook-and-loop material can be utilized as the fastening material.

In summary, the first embodiment depicted herein shows a ballistic vest and holster combination, the combination comprising a ballistic vest (ballistic vest 102) and a holster (holster 110) that is removably attachable to the ballistic vest so that the ballistic vest can be used with or without the holster. The ballistic vest includes a rear torso protection panel and a front torso protection panel. The rear torso protection panel has at least one waist strap (waist straps 106) extending from each side thereof, each waist strap comprising a section of waist strap engaging material. In turn, the front torso protection panel has a section of mating waist strap engaging material spanning across a lower region thereof. The ballistic vest further includes first and second shoulder straps (shoulder straps 104) extending between the rear torso protection panel and the front torso protection panel. The holster, in turn, comprises a front panel (front panel 124) and a rear panel (rear panel 122) connected along a lower edge thereof. A quick-release fastening feature (quick-release fasteners 128) is disposed upon facing left and right sides of each of the front and rear panels. A firearm pocket (firearm receiving section 140) is formed between the coupled front and rear panels upon fastening the quick-release fastening feature. The front panel is pullable away from the rear panel to facilitate access to the firearm pocket, and thus to a firearm (firearm 160) housed in the firearm pocket. Further, the holster includes a holster-to-vest securing feature (holster-to-vest securing feature 130) disposed upon a lower portion of an exterior side of the rear panel, the holster-to-vest securing feature being compatible for coupling with the mating waist strap engaging material of the front torso protection panel of the ballistic vest. In addition, the holster includes a front coupling feature (front coupling feature 112) affixed to a lower portion of an exterior side of the front panel, the front coupling feature being compatible for coupling with the waist strap engaging material of the at least one waist strap of the ballistic vest. Thus, the holster can be sandwiched, and attached, in between the front torso protection panel and the waist straps of the ballistic vest. Finally, the holster further includes at least one shoulder strap engaging portion (securing straps 114) affixed to and extending from the rear panel and configured to disconnectably engage with a corresponding at least one of the shoulder straps of the ballistic vest, and to secure the rear panel of the holster in place when pulling the front panel away from the rear panel.

Figure 13:
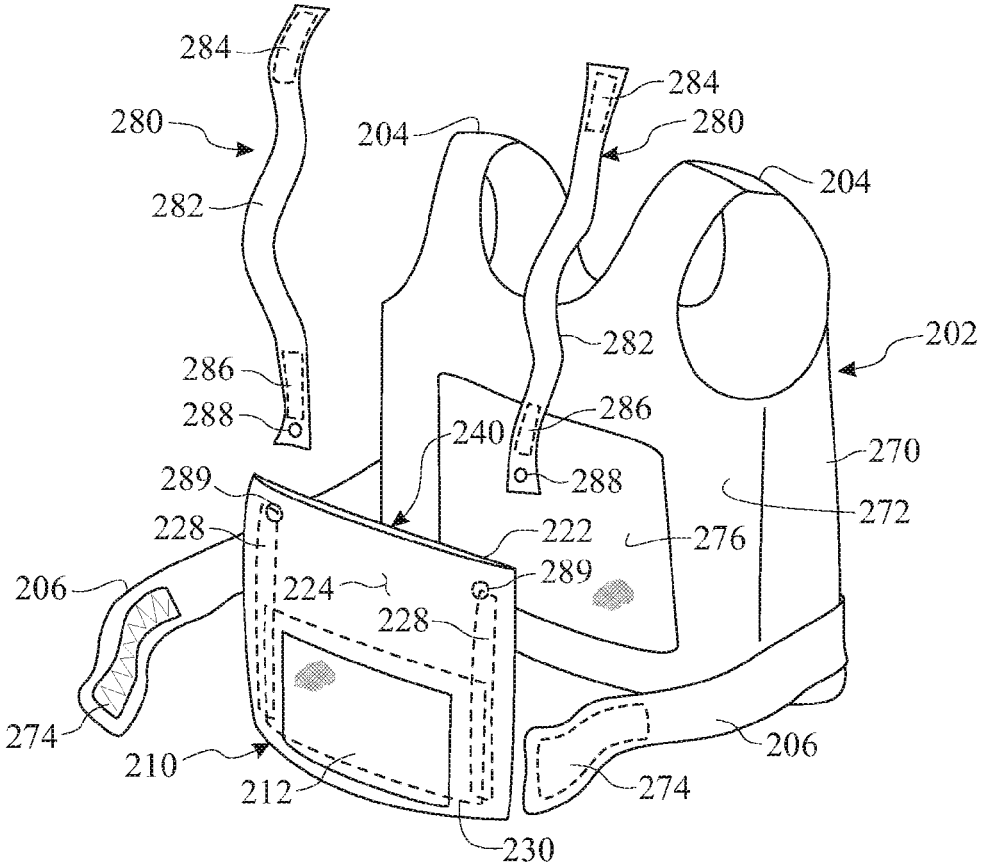
FIG. 13 presents a top front view of a ballistic vest and holster combination in accordance with a second exemplary embodiment of the invention, the holster shown separated from the ballistic vest.
Figure 14:
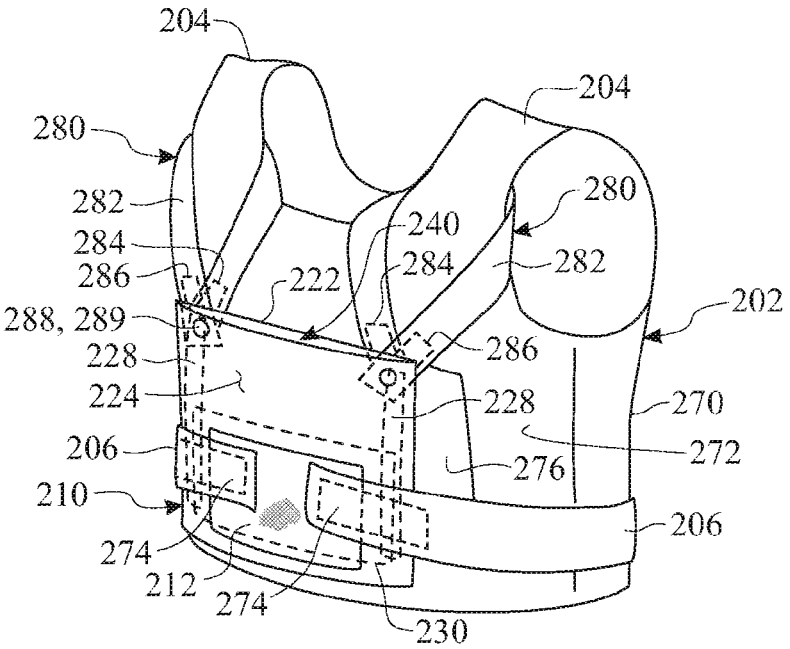
FIG. 14 presents a top front view of the ballistic vest and holster combination of FIG. 13, shown assembled.

The illustrations of FIGS. 13 and 14 show a ballistic vest and holster combination in accordance with a second exemplary embodiment of the invention. Like features of the ballistic vest and holster combination of the second embodiment are numbered the same as the first embodiment except preceded by the numeral '2'. The ballistic vest and holster combination comprises a ballistic vest 202 and a holster 210 that can be removably attached to the ballistic vest 202. Similarly to the previous embodiment, the ballistic vest 202 includes a rear torso protection panel 270 and a front torso protection panel 272. At least one waist strap 206 extends from each side of the rear torso protection panel 270, each waist strap 206 comprising a section of waist strap engaging material 274. In turn, the front torso protection panel 272 includes a section of mating waist strap engaging material 276 spanning across a lower region of the front torso protection panel 272. When used without the holster 210, the waist straps 206 can be extended and attached to the front torso protection panel 272 by engaging the waist strap engaging materials 274, 276. The ballistic vest 202 further includes first and second shoulder straps 204 extending between the rear torso protection panel 270 and the front torso protection panel 272.

The holster 210 comprises a rear panel 222 and a front panel 224 which are connected along a lower edge of the panels 222, 224, and optionally along a bottom portion of side edges of the panels 222, 224. A quick-release fastening feature 228 is disposed upon facing left and right sides of each of the front and rear panels 224, 222. A firearm pocket or firearm receiving section 240 is formed between the coupled front and rear panels 224, 222 upon fastening the quick-release fastening feature 228. The front panel 224 is pullable away from the rear panel 222 to facilitate access to the firearm receiving section 240. A holster-to-vest securing feature 230 is disposed upon a lower portion of an exterior side of the rear panel 222. The holster-to-vest securing feature 230 is compatible for coupling with the mating waist strap engaging material 276 of the front torso protection panel 272 of the ballistic vest 202. In turn, a front coupling feature 212 is affixed to a lower portion of an exterior side of the front panel 224. The front coupling feature 212 is compatible for coupling with the waist strap engaging material 274 of the waist straps 206 of the ballistic vest 202. In some embodiments, the waist strap engaging material 274 and the holster-to-vest securing feature 230 are one portion of a hook-and-loop fastening feature, and the mating waist strap engaging material 276 and the front coupling feature 212 are a mating portion of a hook-and-loop fastening feature, providing an extremely convenient quick-release attachment therebetween.

The holster 210 further includes at least one shoulder strap engaging portion 280 (two, in the present embodiment), as shown in FIG. 14. The shoulder strap engaging portions 280 of the present embodiment are formed as elongated straps comprising a strap body 282. Each shoulder strap engaging portion 280 can be affixed to the rear panel 222 and can extend from the rear panel 222, preferably from an upper region thereof, and more preferably from a left side and a right side of the upper region of the rear panel 222, as shown. Each shoulder strap engaging portion 280 disconnectably engages with one of the shoulder straps 204 of the ballistic vest 202. By engaging with the shoulder straps 204, the shoulder strap engaging portions 280 secure the rear panel 222 of the holster 210 in place when pulling the front panel 224 away from the rear panel 222.

As shown, a distal end and a proximal end of each shoulder strap engaging portion 280 are reversibly attachable to and detachable from one another to switch between a looped configuration (FIG. 14) and an extended or non-looped configuration (FIG. 13). For instance and without limitation, the shoulder strap engaging portions 280 can include first and second quick-release fasteners 284, 286 to attach the ends of the strap body 282 to each other. The first and second quick-release fasteners 284, 286 can include hook-and-loop fasteners (as shown), snap fasteners, magnetic fasteners, or the like. Thus, as shown in FIG. 14, each shoulder strap engaging portion 280 can adopt a looped, securing position in which the shoulder strap engaging portion 280 is wrapped around a shoulder strap 204 of the ballistic vest 202 and the distal end of the shoulder strap engaging portion 280 is attached to the proximal end of the same shoulder strap engaging portion 280. Alternative embodiments are contemplated in which the looped, securing position may be achieved by attaching a distal end of the shoulder strap engaging portion 280 with the rear panel 222 of the holster 210 instead of with the shoulder strap engaging portion 280. For this purpose, quick-release fasteners (similar to the first and second quick-release fasteners 284, 286) would be provided on the distal end of the shoulder strap engaging portion 280 and on the rear panel 222.

Unlike the first embodiment (FIG. 1), in which the shoulder strap engaging portions (securing straps 114) are non-disconnectably affixed to the upper region of the rear panel 122 of the holster 110, the shoulder strap engaging portions 280 of present embodiment are disconnectably affixed to the upper region of the rear panel 222 of the holster 210. Specifically, the shoulder strap engaging portions 280 can include a third quick-release fastener 288 configured to engage with a mating quick-release fastener 289 on the rear panel 222. For instance and without limitation, the quick-release fasteners 288, 289 can include hook-and-loop fasteners, snap fasteners (as shown), magnetic fasteners, or the like. Furthermore, the shoulder strap engaging portions 280 can detached from and attached to the upper region of the rear panel 222 in a reversible manner. In other words, a user can remove the shoulder strap engaging portions 280 from the holster 210 when not in use on the ballistic vest 202, such as to store the holster 210 in a backpack, bag, purse, drawer, etc., and re-attach the shoulder strap engaging portions 280 when using the holster 210 in combination with the ballistic vest 202.

Figure 15:
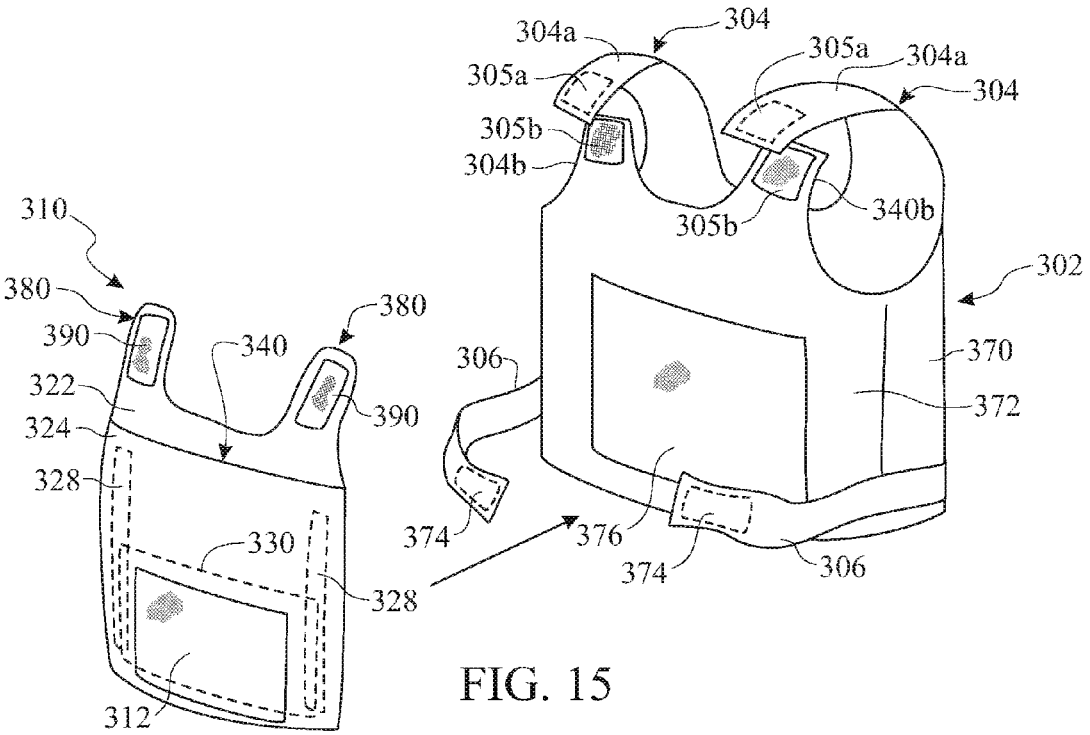
FIG. 15 presents a top front view of a ballistic vest and holster combination in accordance with a third exemplary embodiment of the invention, the holster shown separated from the ballistic vest.
Figure 16:
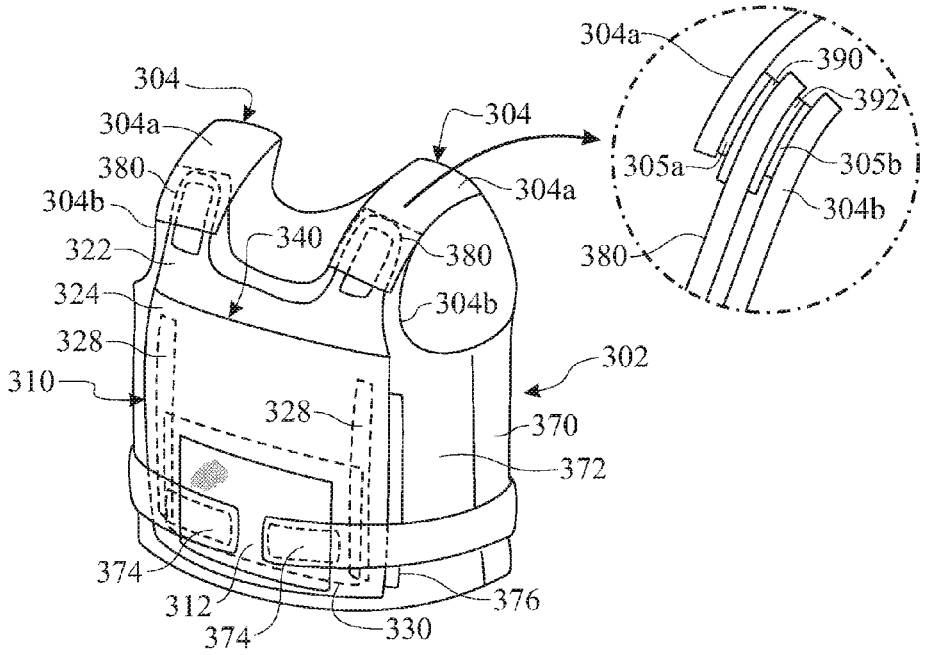
FIG. 16 presents a top front view of the ballistic vest and holster combination of FIG. 15, the holster shown assembled on the ballistic vest, and an enlarged, partial schematic side elevation view of a shoulder strap engaging portion sandwiched between the front and rear strap segments of a ballistic vest shoulder strap.

The illustrations of FIGS. 15 and 16 show a ballistic vest and holster combination in accordance with a third exemplary embodiment of the invention. Like features of the ballistic vest and holster combination of the third embodiment are numbered the same as the first embodiment except preceded by the numeral '3'. Similarly to the previous embodiments, the ballistic vest and holster combination comprises a ballistic vest 302 and a holster 310 that can be removably attached to the ballistic vest 302. The ballistic vest 302 includes a rear torso protection panel 370 and a front torso protection panel 372. At least one waist strap 306 extends from each side of the rear torso protection panel 370, each waist strap 306 comprising a section of waist strap engaging material 374. In turn, the front torso protection panel 372 includes a section of mating waist strap engaging material 376 spanning across a lower region of the front torso protection panel 372. When used without the holster 310, the waist straps 306 can be extended and attached to the front torso protection panel 372 by engaging the waist strap engaging materials 374, 376. The ballistic vest 302 further includes first and second shoulder straps 304 extending between the rear torso protection panel 370 and the front torso protection panel 372.

Also similarly to the previous embodiments, the holster 310 comprises a rear panel 322 and a front panel 324 which are connected along a lower edge of the panels 322, 324, and optionally along a bottom portion of side edges of the panels 322, 324. A quick-release fastening feature 328 is disposed upon facing left and right sides of each of the front and rear panels 324, 322. A firearm pocket or firearm receiving section 340 is formed between the coupled front and rear panels 324, 322 upon fastening the quick-release fastening feature 328. The front panel 324 is pullable away from the rear panel 322 to facilitate access to the firearm receiving section 340. A holster-to-vest securing feature 330 is disposed upon a lower portion of an exterior side of the rear panel 322. The holster-to-vest securing feature 330 is compatible for coupling with the mating waist strap engaging material 376 of the front torso protection panel 372 of the ballistic vest 302. In turn, a front coupling feature 312 is affixed to a lower portion of an exterior side of the front panel 324. The front coupling feature 312 is compatible for coupling with the waist strap engaging material 374 of the waist straps 306 of the ballistic vest 302. In some embodiments, the waist strap engaging material 374 and the holster-to-vest securing feature 330 are one portion of a hook-and-loop fastening feature, and the mating waist strap engaging material 376 and the front coupling feature 312 are a mating portion of a hook-and-loop fastening feature, providing an extremely convenient quick-release attachment therebetween.

The ballistic vest 302 of the present embodiment is different in that at least one of the shoulder straps 304 (both, in the illustrated embodiment) is divided into a rear strap segment 304*a* and a front strap segment 304*b*, respectively extending from the rear torso protection panel 270 and the front torso protection panel 372. The rear and front strap segments 304*a*, 304*b* are removably attachable to one another by a respective shoulder strap fastener 305*a*, 305*b* arranged on the rear and front strap segments 304*a*, 304*b*.

Similarly to previous embodiments, the holster 310 further includes at least one shoulder strap engaging portion 380 (two, in the illustrated embodiment) affixed to and extending from the rear panel 322, each shoulder strap engaging portion 380 configured to disconnectably engage with one of the shoulder straps 304 of the ballistic vest 203 and secure the rear panel 322 of the holster 310 in place when pulling the front panel 324 away from the rear panel 322. In the present embodiment, however, the shoulder strap engaging portions 380 are formed as top, opposite side non-disconnectable extensions of the rear panel 322, each shoulder strap engaging portion 380 including two engaging portion fasteners 390, 392. The engaging portion fasteners 390, 392 are compatible for coupling, respectively, with the shoulder strap fasteners 305*a*, 305*b* of the rear strap segment and the front strap segment 304*a*, 304*b*. Thus, as shown in FIG. 16, the shoulder strap engaging portions 380 can adopt an assembled configuration in which the shoulder strap engaging portions 380 are attached to both the front strap segment 304*a* and the rear strap segment 304*b*, and thus engage with the shoulder straps 304. By engaging with the shoulder straps 204, the shoulder strap engaging portions 380 secure the rear panel 322 of the holster 310 in place when pulling the front panel 324 away from the rear panel 322.

As best shown in FIG. 15, the shoulder strap fasteners 305*a*, 305*b* of the rear and front strap segments 304*a*, 304*b* are respectively arranged on an inner surface of the rear strap segment 304*a* and on an outer surface of the front strap segment 304*b*, the shoulder strap fasteners 305*a*, 305*b* capable of facing one another as shown in FIG. 15 to attach to one another when not using the holster 310; alternative embodiments are contemplated in which the rear and front strap segments 304*a*, 304*b* can be respectively arranged on an outer surface of the rear strap segment 304*a* and on an inner surface of the front strap segment 304*b*. In turn, the engaging portion fasteners 390, 392 of the each shoulder strap engaging portion 380 are arranged on a front side and a rear side, respectively, of the shoulder strap engaging portion 380, as shown in the enlarged side elevation view in the top right corner of FIG. 16. Each shoulder strap engaging portion 380 is configured to be sandwiched between the rear strap segment 304*a* and the front strap segment 304*b*, and attached to the rear and front strap segments 304*a*, 304*b* by coupling of the inner shoulder strap fastener 305*a* with the front engaging portion fastener 390 and by coupling of the outer shoulder strap fastener 305*b* with the rear engaging portion fastener 392. Such a sandwiched configuration provides an easy and quick, yet extremely resistant and secure attachment of the shoulder strap engaging portions 380 to the shoulder straps 304. In the present embodiment, the inner shoulder strap fastener 305*a* and front engaging portion fastener 390 are one portion of a hook-and-loop fastening feature, and the outer shoulder strap fastener 305*b* and rear engaging portion fastener 392 are a mating portion of a hook-and-loop fastening feature, contributing to facilitate attaching and detaching the shoulder strap engaging portions 380 to the shoulder straps 304.

While not shown, the embodiments of FIGS. 13-14 and 15-16 can optionally include a holster access finger loop similar to the holster access finger loop 116 of FIG. 1, a quick-release fastening feature similar to the quick-release fastener 134 of FIG. 2, a firearm holder similar to the firearm holder 162 of FIG. 8, and a trauma pad similar to trauma pad similar to the trauma pad 152 of FIG. 5.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A ballistic vest and holster combination, the combination comprising:

a ballistic vest comprising:

a rear torso protection panel having at least one waist strap extending from each side thereof, each waist strap comprising a section of waist strap engaging material, and a front torso protection panel having a section of mating waist strap engaging material spanning across a lower region thereof, a first shoulder strap and a second shoulder strap extending between the rear torso protection panel and the front torso protection panel; and a holster removably attachable to the ballistic vest, the holster comprising:

a front panel and a rear panel, the front panel and rear panel being connected along a lower edge;

a quick-release fastening feature disposed upon facing left and right sides of each of the front and rear panels, a firearm pocket being formed between the coupled front and rear panels upon fastening the quick-release fastening feature, the front panel being pullable away from the rear panel to facilitate access to the firearm pocket;

a holster-to-vest securing feature disposed upon a lower portion of an exterior side of the rear panel, the holster-to-vest securing feature being compatible for coupling with the mating waist strap engaging material of the front torso protection panel of the ballistic vest;

a front coupling feature affixed to a lower portion of an exterior side of the front panel, the front coupling feature being compatible for coupling with the waist strap engaging material of the at least one waist strap of the ballistic vest; and at least one shoulder strap engaging portion affixed to and extending from the rear panel and configured to disconnectably engage with one of the shoulder straps of the ballistic vest and secure the rear panel of the holster in place when pulling the front panel away from the rear panel.

2. The ballistic vest and holster combination of claim 1, wherein the waist strap engaging material and the holster-to-vest securing feature are one portion of a hook-and-loop fastening feature, and further wherein the mating waist strap engaging material and the front coupling feature are a mating portion of a hook-and-loop fastening feature.

3. The ballistic vest and holster combination of claim 1, wherein a proximal end of the at least one shoulder strap engaging portion extends from an upper region of the rear panel of the holster.

4. The ballistic vest and holster combination of claim 3, wherein the at least one shoulder strap engaging portion comprises one shoulder strap engaging portion extending from a left side of the upper region of the rear panel and another shoulder strap engaging portion extending from a right side of the upper region of the rear panel.

5. The ballistic vest and holster combination of claim 3, wherein said proximal end of the at least one shoulder strap engaging portion is non-disconnectably affixed to the upper region of the rear panel.

6. The ballistic vest and holster combination of claim 3, wherein said proximal end of the at least one shoulder strap engaging portion is disconnectably affixed to the upper region of the rear panel, and is reversibly attachable to and detachable from said upper region of the rear panel.

7. The ballistic vest and holster combination of claim 3, wherein a distal end of the at least one shoulder strap engaging portion is reversibly attachable to and detachable from said at least one shoulder strap engaging portion, and further wherein the at least one shoulder strap engaging portion is configured to adopt a looped, securing position in which the at least one shoulder strap engaging portion is wrapped around said one of the shoulder straps of the ballistic vest and said distal end of the at least one shoulder strap engaging portion is attached to said at least one shoulder strap engaging portion.

8. The ballistic vest and holster combination of claim 3, wherein a distal end of the at least one shoulder strap engaging portion is reversibly attachable to and detachable from said rear panel of said holster, and further wherein the at least one shoulder strap engaging portion is configured to adopt a looped, securing position in which the at least one shoulder strap engaging portion is wrapped around said one of the shoulder straps of the ballistic vest and said distal end of the at least one shoulder strap engaging portion is attached to said rear panel of said holster.

9. The ballistic vest and holster combination of claim 3, wherein:

at least one of the first and second shoulder straps is divided into a front strap segment and a rear strap segment, respectively extending from the front torso protection panel and the rear torso protection panel and removably attachable to one another by a respective shoulder strap fastener arranged on each one of the front strap segment and the rear strap segment; wherein the at least one shoulder strap engaging portion includes two engaging portion fasteners, wherein one engaging portion fastener is compatible for coupling with one of the respective shoulder strap fasteners of the front strap segment and the rear strap segment, and the other engaging portion fastener is compatible with the other of the respective shoulder strap fasteners of the front strap segment and the rear strap segment.

10. The ballistic vest and holster combination of claim 9, wherein:

the respective shoulder strap fasteners of the front strap segment and the rear strap segment comprise an inner shoulder strap fastener arranged on an inner surface of one of the front strap segment and the rear strap segment and an outer shoulder strap fastener arranged on an outer surface of the other of the front strap segment and the rear strap segment, said front shoulder strap fastener and said rear shoulder strap fastener facing one another; wherein the engaging portion fasteners of the at least one shoulder strap engaging portion comprise a front engaging portion fastener arranged on a front side of the at least one shoulder strap engaging portion and a rear engaging portion fastener arranged on a rear side of the at least one shoulder strap engaging portion; and the at least one shoulder strap engaging portion is configured to be sandwiched between the front strap segment and the rear strap segment and attached thereto by coupling of the inner shoulder strap fastener with the front engaging portion fastener and by coupling of the rear engaging portion fastener with the outer shoulder strap fastener.

11. The ballistic vest and holster combination of claim 10, wherein the inner shoulder strap fastener and front engaging portion fastener are one portion of a hook-and-loop fastening feature, and the outer shoulder strap fastener and rear engaging portion fastener are a mating portion of a hook-and-loop fastening feature.

12. The ballistic vest and holster combination of claim 1, wherein the holster comprises a internal fastening material disposed upon an interior side of the rear panel, and further wherein the at least one shoulder strap engaging portion comprises a first securing strap and a second securing strap respectively extending from an upper right portion and an upper left portion of the rear panel, the first securing strap and second securing strap comprising a respective strap fastener arranged at a distal portion of the strap, at least one of the first securing strap and the second securing strap wrapping around one of the shoulder straps and being coupled to the internal fastening material.

13. The ballistic vest and holster combination of claim 1, further comprising a holster access finger loop affixed to an upper portion of the holster front panel.

14. The ballistic vest and holster combination of claim 1, further comprising a quick-release fastening feature disposed upon facing top sides of each of the front and rear panels of the holster, positioned proximate a center of a top portion of said front and rear panels.

15. The ballistic vest and holster combination of claim 1, further comprising a firearm holder removably attachable to an internal fastening material on an interior side of the rear panel of the holster.

16. The ballistic vest and holster combination of claim 1, wherein the holster further comprises a trauma pad including a plate fastening strip, wherein the trauma pad plate fastening strip is configured to removably attach to a pocket front internal fastening strip affixed to an interior side of the front panel of the holster when the trauma pad is inserted into the firearm pocket delimited between the coupled front and rear panels of the holster.

17. A ballistic vest and holster combination, the combination comprising:

a ballistic vest comprising:

a rear torso protection panel having at least one waist strap extending from each side thereof, each waist strap comprising a section of waist strap engaging material, and a front torso protection panel having a section of mating waist strap engaging material spanning across a lower region thereof, a first shoulder strap and a second shoulder strap extending between the rear torso protection panel and the front torso protection panel; and a holster removably attachable to the ballistic vest, the holster comprising:

a front panel and a rear panel, the front panel and rear panel being connected along a lower edge;

a quick-release fastening feature disposed upon facing left and right sides of each of the front and rear panels, a firearm pocket being formed between the coupled front and rear panels upon fastening the quick-release fastening feature, the front panel being pullable away from the rear panel to facilitate access to the firearm pocket;

a holster-to-vest securing feature disposed upon a lower portion of an exterior side of the rear panel, the holster-to-vest securing feature being compatible for coupling with the mating waist strap engaging material of the front torso protection panel of the ballistic vest;

a front coupling feature affixed to a lower portion of an exterior side of the front panel, the front coupling feature being compatible for coupling with the waist strap engaging material of the at least one waist strap of the ballistic vest; and at least one shoulder strap engaging portion affixed to and extending from an upper region of the rear panel and configured to disconnectably engage with one of the shoulder straps of the ballistic vest and secure the rear panel of the holster in place when pulling the front panel away from the rear panel.

18. The ballistic vest and holster combination of claim 17, wherein the waist strap engaging material and the holster-to-vest securing feature are one portion of a hook-and-loop fastening feature, and further wherein the mating waist strap engaging material and the front coupling feature are a mating portion of a hook-and-loop fastening feature.

19. The ballistic vest and holster combination of claim 17, further comprising a firearm holder removably attachable to an internal fastening material on an interior side of the rear panel of the holster.

20. A ballistic vest and holster combination, the combination comprising:

a ballistic vest comprising:

a rear torso protection panel having at least one waist strap extending from each side thereof, each waist strap comprising a section of waist strap engaging material, and a front torso protection panel having a section of mating waist strap engaging material spanning across a lower region thereof, a first shoulder strap and a second shoulder strap extending between the rear torso protection panel and the front torso protection panel; and a holster removably attachable to the ballistic vest, the holster comprising:

a front panel and a rear panel, the front panel and rear panel being connected along a lower edge;

a quick-release fastening feature disposed upon facing left and right sides of each of the front and rear panels, a firearm pocket being formed between the coupled front and rear panels upon fastening the quick-release fastening feature, the front panel being pullable away from the rear panel to facilitate access to the firearm pocket;

a holster-to-vest securing feature disposed upon a lower portion of an exterior side of the rear panel, the holster-to-vest securing feature being compatible for coupling with the mating waist strap engaging material of the front torso protection panel of the ballistic vest;

a front coupling feature affixed to a lower portion of an exterior side of the front panel, the front coupling feature being compatible for coupling with the waist strap engaging material of the at least one waist strap of the ballistic vest; and two shoulder strap engaging portions affixed to and extending respectively from a left side and a right side of an upper region of the rear panel and configured to disconnectably engage with the first and second shoulder straps of the ballistic vest and secure the rear panel of the holster in place when pulling the front panel away from the rear panel.

* * * * *